United States Patent [19]

Kusch

[11] Patent Number: 4,537,393

[45] Date of Patent: Aug. 27, 1985

[54] NECK EXERCISER

[76] Inventor: Richard J. Kusch, Box 205, Pewaukee, Wis. 53072

[21] Appl. No.: 502,189

[22] Filed: Jun. 8, 1983

[51] Int. Cl.[3] ..... A63B 21/12; A63B 21/16

[52] U.S. Cl. ..... 272/94; 272/68; 272/142; 272/109

[58] Field of Search ..... 272/61, 67, 68, 94, 272/109, 142, 78, 93, 136–139; 128/25 R, 26, 75

[56] References Cited

U.S. PATENT DOCUMENTS

| | | | |
|---|---|---|---|
| 1,517,147 | 11/1924 | Burnett | 272/94 |
| 2,107,377 | 2/1938 | Howland | 272/109 |
| 2,496,748 | 2/1950 | Pond | 272/109 |
| 3,532,340 | 10/1970 | Nardiello | 272/142 |
| 4,111,415 | 9/1978 | Reitano | 272/94 |

FOREIGN PATENT DOCUMENTS

| | | | |
|---|---|---|---|
| 848319 | 8/1970 | Canada | 272/67 |
| 2424449 | 12/1975 | Fed. Rep. of Germany | 272/67 |

*Primary Examiner*—Richard J. Apley
*Assistant Examiner*—S. R. Crow
*Attorney, Agent, or Firm*—Thomas B. Tate

[57] ABSTRACT

The invention is a device designed to aid in exercising various muscles of the human body, especially the muscles of the neck region, but also the muscles of the back, side, and stomach regions. The device comprises a ring supported from a wall by brackets, a plurality of bracket members rotatably mounted on the ring, and springs attached to the rotatable bracket members and also to a head harness positioned in the center of the diameter of the ring.

1 Claim, 3 Drawing Figures

NECK EXERCISER

SUMMARY OF THE INVENTION

The invention is an exercise device comprising a ring supported from a wall by brackets, a plurality of bracket members rotatably mounted on said ring, and springs attached to said bracket members and to a head harness.

The primary object of the invention is to provide a safe, effective means of exercising the neck muscles; however, the invention can also be used to exercise other muscles, especially the back, side, and stomach muscles. The invention accomplishes this objective by means of the rotating bracket members which allow for smooth movement of the neck muscles, and the springs which provide resistance against which a person can exercise, and can be of varying tension strengths as desired by the user.

Examples of exercises which can be performed on the invention are:

(1) sitting in a chair with the head in the harness and arms at one's sides, rotating head in all directions or thrusting head in one direction and holding this position for a period of time;

(2) standing with the head in the harness and the hands holding the ring, rotating the neck;

(3) standing with the head in the harness and the hands on the head, thrusting back and forth and sideways using the torso muscles.

DESCRIPTION OF THE INVENTION

The invention is a neck exerciser comprising a ring (preferably made of steel or other metal), support brackets, rotatable bracket members, springs, and a head harness.

The ring 10 is substantially circular in shape and is positioned substantially parallel to the floor. A plurality of support brackets 11 attach the ring 10 to a wall or similar supporting surface, in a manner similar to that used for suspending a basketball hoop from a backboard.

Figure 1:
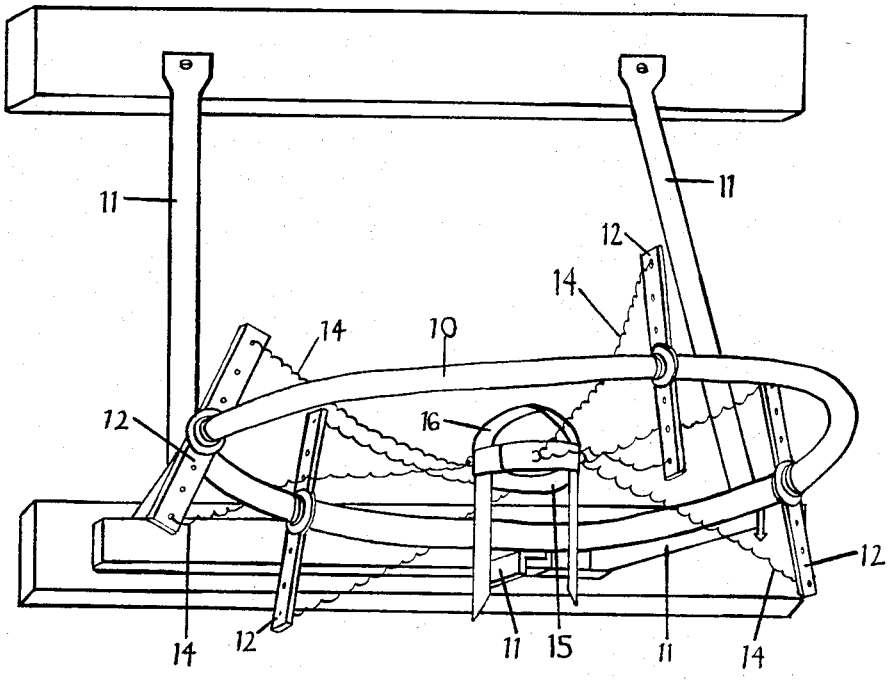
FIG. 1 is a three-quarter view from below.
Figure 2:
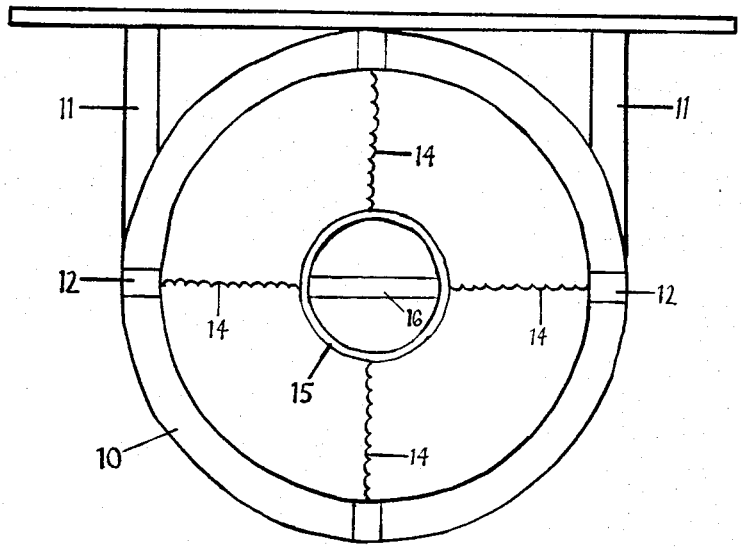
FIG. 2 is a top view.
Figure 3:
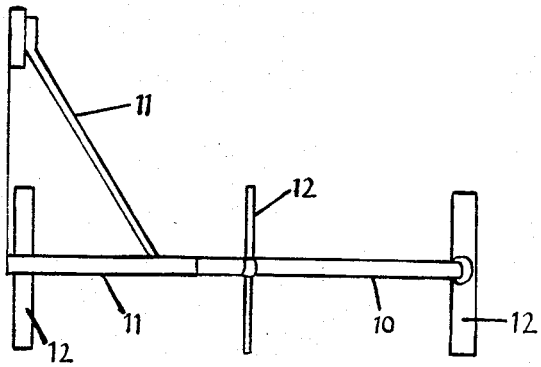
FIG. 3 is a side view showing the suspension of the ring from the wall.

A plurality of bracket members 12 are rotatably mounted on the ring 10 as best shown in FIG. 1. Each bracket member 12 can pivot 360 degrees around the ring 10. The bracket members 12 are mounted at approximately equal intervals. In the preferred embodiment of the invention, there are four bracket members 12, 90 degrees apart, as best seen in FIG. 2.

A plurality of springs 14 are each attached at one end to one of the bracket members 12 and at the other end to a head harness 15 which is positioned in the center opening of the ring 10. Since each bracket member 12 is provided with a plurality of openings through which the springs 14 can attach, the number and positioning of the springs 14 can vary. In the preferred embodiment of the invention, there are from one to three springs 14 attached to each bracket member 12.

The head harness 15 is made of leather or similar material, is adjustable to fit the head of the person exercising, and is provided with an adjustable chin strap 16.

I claim:

1. A device for exercising various muscles of the human body, especially the neck muscles, said exercise device comprising:

a ring;

a plurality of support brackets attaching said ring to a wall to support said ring in a plane substantially parallel to the floor;

a plurality of bracket members rotatably mounted on said ring at approximately equal intervals;

harness means adjustable to fit the head of the person exercising, said harness means being positioned approximately in the center of the diameter of said ring;

a plurality of springs, each of which attaches at one end to one of said rotatably mounted bracket members and attaches at the opposite end to said harness means, said springs providing resistance against which exercises can be performed.

* * * * *